US007413022B2

(12) United States Patent
Broome et al.

(10) Patent No.: US 7,413,022 B2
(45) Date of Patent: Aug. 19, 2008

(54) EXPANDABLE FLOW CONTROL DEVICE

(75) Inventors: John T. Broome, The Woodlands, TX (US); Knut H. Henriksen, Houston, TX (US)

(73) Assignee: Baker Hughes Incorporated, Housoton, TX (US)

( * ) Notice: Subject to any disclaimer, the term of this patent is extended or adjusted under 35 U.S.C. 154(b) by 197 days.

(21) Appl. No.: 11/142,160

(22) Filed: Jun. 1, 2005

(65) Prior Publication Data

US 2006/0272814 A1 Dec. 7, 2006

(51) Int. Cl.
*E21B 43/10* (2006.01)
*E21B 43/02* (2006.01)
*E21B 43/08* (2006.01)

(52) U.S. Cl. ..... 166/386; 166/206; 166/227; 166/228

(58) Field of Classification Search ..... 166/277, 166/228, 278, 386, 206
See application file for complete search history.

(56) References Cited

U.S. PATENT DOCUMENTS

| | | | | |
|---|---|---|---|---|
| 3,450,207 | A | 6/1969 | Hirsch | |
| 5,435,393 | A | 7/1995 | Brekke et al. | |
| 6,109,349 | A * | 8/2000 | Simone et al. | 166/230 |
| 6,112,815 | A | 9/2000 | Boe et al. | |
| 6,112,817 | A | 9/2000 | Voll et al. | |
| 6,619,401 | B2 * | 9/2003 | Echols et al. | 166/369 |
| 6,749,023 | B2 * | 6/2004 | Nguyen et al. | 166/278 |
| 6,877,553 | B2 * | 4/2005 | Cameron | 166/207 |
| 7,048,063 | B2 * | 5/2006 | Cameron | 166/381 |
| 7,152,687 | B2 * | 12/2006 | Gano | 166/386 |
| 2002/0020524 | A1 | 2/2002 | Gano | |

FOREIGN PATENT DOCUMENTS

| | | | |
|---|---|---|---|
| GB | 2366581 | A | 3/2002 |
| WO | WO 01/83943 | A1 | 11/2001 |

OTHER PUBLICATIONS

Augustine, Jody R., et al., "An Investigation of the Economic Benefit of Inflow control Devices on Horizontal Well Completions Using a Reservior-Wellbore Coupled Model", SPE 78293, Oct. 2002, pp. 1-10.

Baker Hughes, Baker Oil Tools Product Report, "Equalizer Screen", Product Family Nos. H48678, H48692, and H48693, 2002, 1 page.

* cited by examiner

*Primary Examiner*—Shane Bomar
(74) *Attorney, Agent, or Firm*—Steve Rosenblatt

(57) ABSTRACT

The invention involves the use of a base pipe perforated only in a specific section under each screen section. Inflow comes through an outer shroud that is optional and goes through the screen material and into an annular space between the screen material and the unperforated base pipe. After traveling longitudinally in that annular space, the flow must go through a restriction that preferably comprises a porous media in a passage defined outside the still unperforated base pipe. After passing through the porous media in a particular screen section, the flow can pass through openings in the base pipe. A surrounding ring preferably protects the porous media during run in and expansion and can also optionally create additional resistance to flow to work in tandem with the porous media. Other flow restricting techniques in place of the porous media are contemplated.

19 Claims, 3 Drawing Sheets

EXPANDABLE FLOW CONTROL DEVICE

FILED OF THE INVENTION

The field of the invention is flow equalizing devices to control inflow from a formation into production tubing in a manner so as to draw more evenly from diverse sections of the producing formation.

BACKGROUND OF THE INVENTION

Annulus flow, particularly in long horizontal runs in a formation creates an undesirable uneven flow into production tubing and encourages production of sand and along with it erosion that adversely affects downhole equipment such as screens. To combat this tendency of uneven inflow caused by annular flow around the outside of screen sections, what has been tried in the past is the addition of a flow control mechanism to individual screen sections to redirect much of the flow that used to come in closer to the uphole or heel end of the screen assembly because that would represent the path of least resistance. In essence, the solution to this problem involved the reconfiguration of the screen sections so that in each screen section the flow could go through the screen material and then in an annular space defined between the screen and the base pipe, which would be non-perforated in the screen section. After passing through that zone the flow would be put through a tortuous path before arriving at a hole in the base pipe. Each section of screen could have a form of this built in resistance so that an assembly of screens in the aggregate would equalize the flow from the formation over the length of the producing zone. To illustrate this approach, reference is made to the Equalizer™ screen sold by Baker Hughes Incorporated of Houston, Tex. and described at length in SPE Paper 78293 entitled An Investigation of the Economic Benefit of Inflow Control Devices on Horizontal Well Completions Using a Reservoir-Wellbore Coupled Model by Jody Augustine. U.S. Pat. Nos. 3,450,207; 5,435,393 and 6,112,815 are also relevant to this concept. In using these devices the annular space was traditionally gravel packed to control annular flow characteristics and limit production of undesirable sand.

More recently, the concept of expansion of pipe downhole has taken hold and screens have been expanded to reduce the size of the surrounding annulus with an eye toward eliminating the need to gravel pack. In long horizontal runs, in particular, there were concerns about the distribution of gravel and the ideal of screen expansion took hold as a way to ease those concerns by reducing the size of the annular space around a screen in open hole of a slotted liner.

However, despite the incorporation of expansion technology the issues relating to annular flow and uneven flow from the formation into the production tubing remained through screens remained. The unique construction of the known flow equalizing devices did not make an assembly that was amenable to expansion. Accordingly, the present invention is directed to an assembly that is amenable to expansion while still providing the capability to distribute flow from a formation evenly into a production string. These and other features of the present invention will be more readily appreciated by those skilled in the art by a review of the detailed description of the preferred embodiment, the drawings and the claims that appear below.

SUMMARY OF THE INVENTION

The invention involves the use of a base pipe perforated only in a specific section under each screen section. Inflow comes through an outer shroud that is optional and goes through the screen material and into an annular space between the screen material and the unperforated base pipe. After traveling longitudinally in that annular space, the flow must go through a restriction that preferably comprises a porous media in a passage defined outside the still unperforated base pipe. After passing through the porous media in a particular screen section, the flow can pass through openings in the base pipe. A surrounding ring preferably protects the porous media during run in and expansion and can also optionally create additional resistance to flow to work in tandem with the porous media. Other flow restricting techniques in place of the porous media are contemplated.

DETAILED DESCRIPTION OF THE PREFERRED EMBODIMENT

Figure 1:
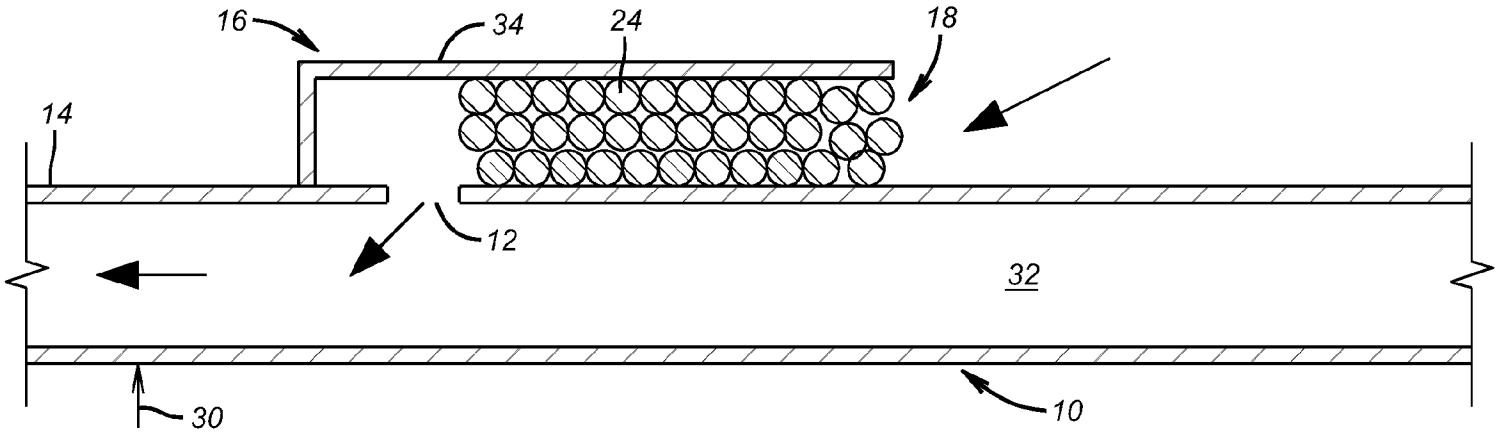
FIG. 1 is a schematic section view of the preferred embodiment of the invention.
Figure 2:
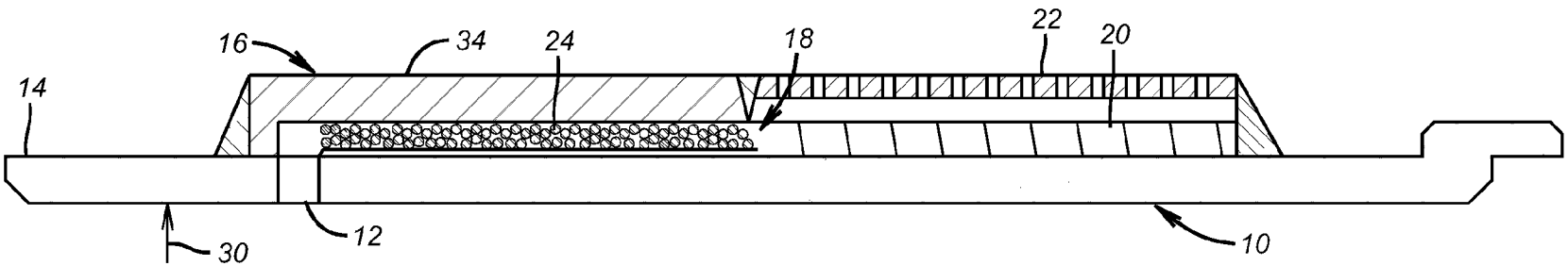
FIG. 2 is a section view of a screen section using the present invention.
Figure 4:
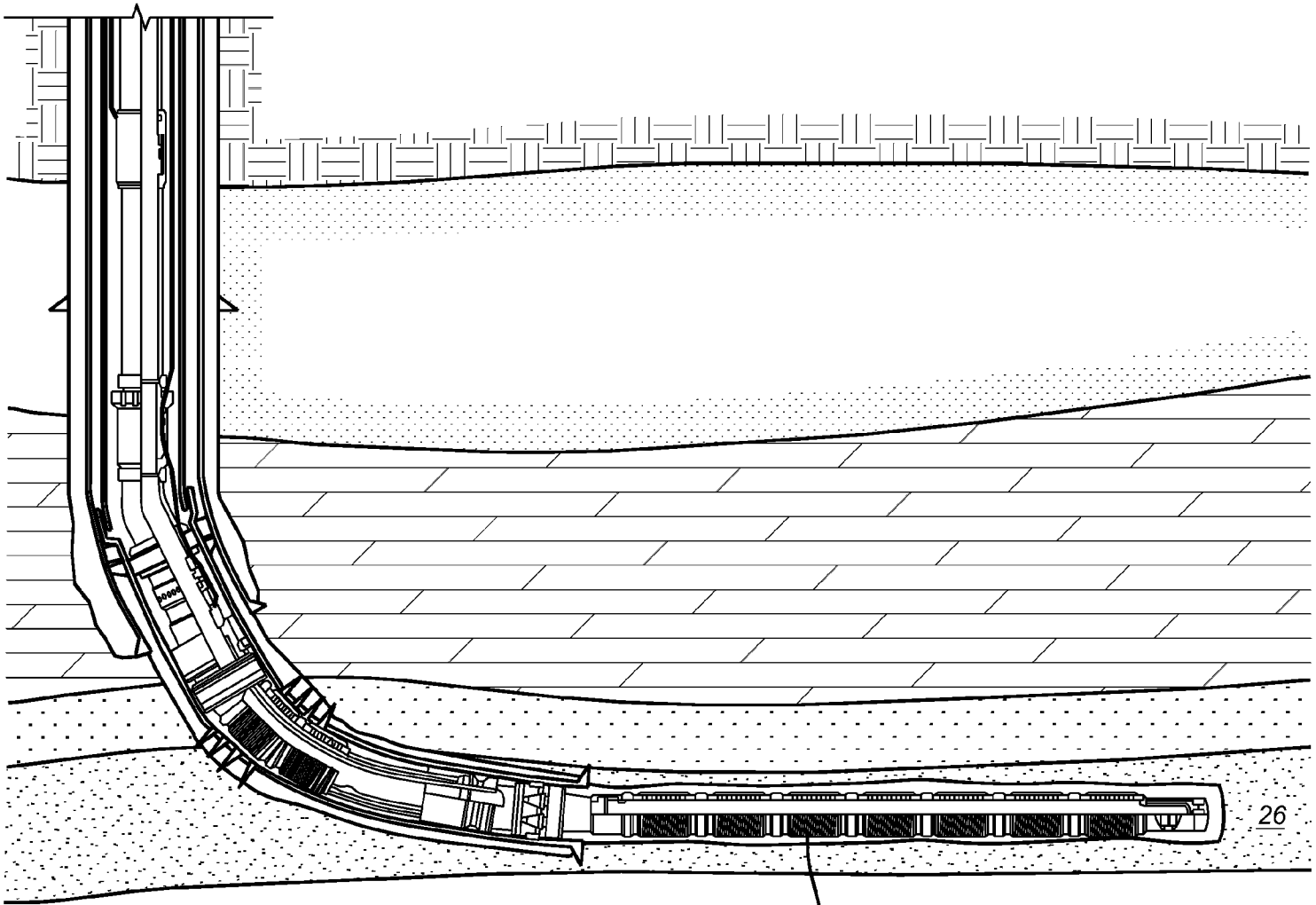
FIG. 4 is a section view of a horizontal completion using an expanded screen assembly incorporating the invention.

Referring to FIGS. 1 and 2, the preferred embodiment of the present invention incorporates a base pipe 10 that comes in sections with a single section shown in FIG. 2. One or more openings 12 are located preferably at the uphole end 14 of base pipe 10. An exterior structure 16 overlays openings 12 to create an inlet 18 for flow that has come in to an annular space 20 shown in FIG. 2 as being under a screen 22. Resistance to flow into the openings 12 is provided, in one embodiment, by a metal or non-metal porous media 24 such as a weave, rods or beads packed layered or sintered to create a flow restriction. While media 24 can filter particles that have gotten through the screen 22 its principle focus is flow resistance to allow balancing flow from a producing zone 26 shown in FIG. 4 where stacks of screen sections 28 extend in what happens to be a near horizontal zone.

Arrow 30 in FIG. 2 represents expansion from within passage 32 inside the base pipe 10. Expansion can be with any known technique such as a fixed or adjustable swage, an inflatable, applied pressure between two seals on a mandrel or a roller expander with fixed or adjustable rollers. In the preferred embodiment, the outer surface is brought into close proximity with the open hole during the expansion. The porous media has some resistance to being crushed in the expansion of the base pipe 10 even if the outer surface 34 comes in contact with the borehole wall or a surrounding tubular during the expansion. The resistance to flow in each screen section need not be identical. There could be more resistance offered further uphole to counteract the paths of least resistance formed there as opposed to screen sections 28 that are further downhole where there is greater resistance to entry and flow to the surface.

As shown in FIG. 1 the invention can be used without any screens at all. It can be simply a series of inlets 12 with a flow restriction 24 associated with each such opening 12 including an exterior structure 16 to help retain the restriction 24 and/or to add an annular passage with an inlet 18 that itself can act as a flow restriction depending on the anticipated flow rates and the cross-sectional area of inlet 18. Alternatively, only some openings can employ the flow restriction 24 and the structure 16. Further flow balancing can be done with regulating the sizes of the openings 12 with the smaller sizes being uphole and the larger sizes being downhole. Flow restriction 24 can act as a filter for fines that get through the screen 22 although the principal function is to provide pressure drop to balance flow among screen sections.

Figure 3:
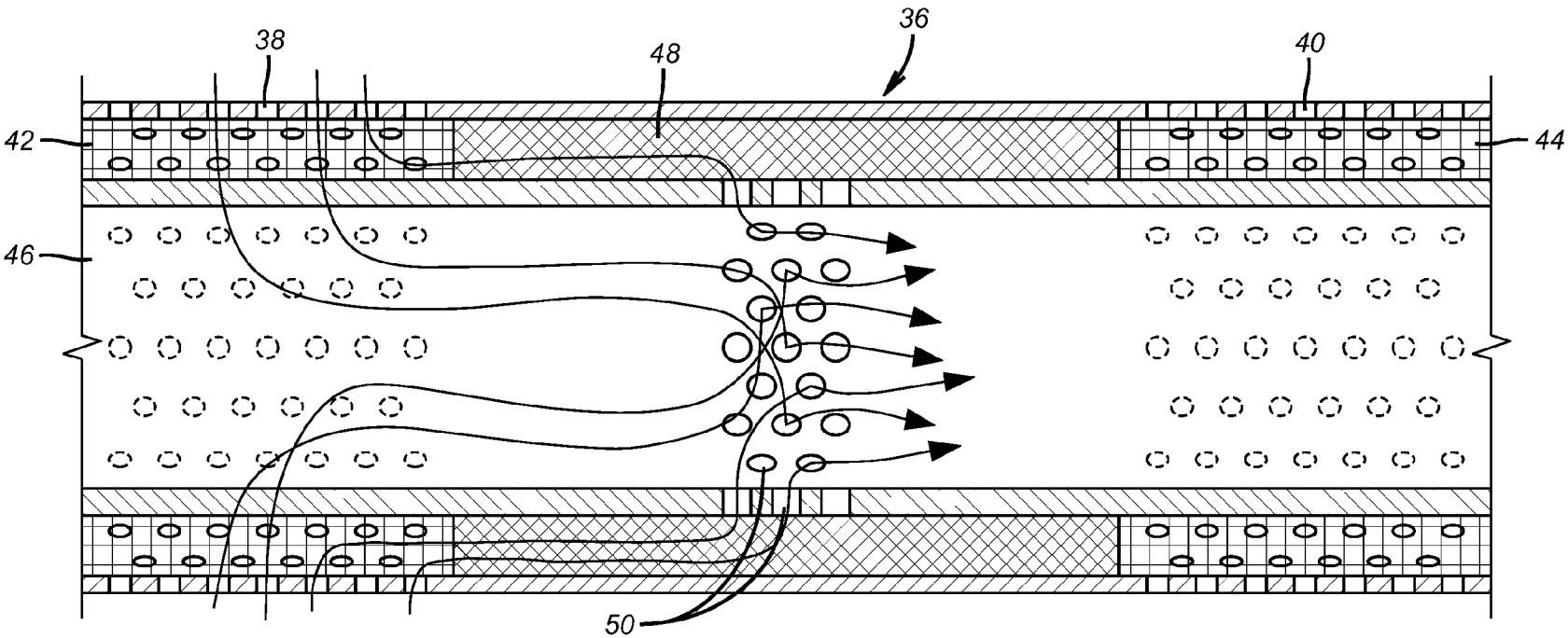
FIG. 3 is an alternative embodiment in a screen application.

FIG. 3 represents an alternative embodiment of a screen section showing an outer jacket 36 that has perforated zones 38 and 40 that lead respectively to screens 42 and 44. The base pipe 46 is not perforated under screens 42 and 44 so that flow moves longitudinally in annular space 48 until it reaches openings 50 from opposed directions. The outer jacket 36 is optional.

The external structure 16 can take many forms. One of its purposes is to create a flow channel to the openings 12. Another use for it would be to contain or protect the porous media 24 during run in or expansion. Advantageously the porous media 24 should be resistant to being crushed in the expansion process.

The present invention can be used to balance the flow of oil gas or water produced from a zone whether the zone is vertical horizontal or anything in between. By assuring more uniform production and further by having a configuration that is amenable to expansion the invention further reduces annular channeling and can in some cases do away with the need for gravel packing while at the same time provide a way to better produce the zone so as to extract the most hydrocarbons from it. The even flow that can be achieved also will reduce erosion and production of other solids or liquids from the zone that can displace the desired fluids from the zone.

The above description is illustrative of the preferred embodiment and many modifications may be made by those skilled in the art without departing from the invention whose scope is to be determined from the literal and equivalent scope of the claims below.

We claim:

1. A method of controlling flow into production tubing from a formation comprising:

locating a tubular having a plurality of openings adjacent the producing formation;

associating non-overlapping and longitudinally spaced flow regulation devices with said openings which are uniquely configured from each other;

expanding said tubing in a region adjacent said openings;

balancing inflow from the formation into the tubular through said openings after expansion.

2. The method of claim 1, comprising:

providing an exterior structure over at least one of said openings.

3. The method of claim 1, comprising:

directing flow along the exterior of said tubular toward at least one of said openings through a path providing resistance to flow.

4. The method of claim 1, comprising:

using, as at least one of said flow regulation devices, a porous media to restrict flow from outside said tubular through at least one said opening.

5. The method of claim 1, comprising:

providing a screen assembly to define at least one annular flowpath between itself and the outside of the tubular;

placing at least one of said flow regulation devices in said flowpath between said screen assembly and at least one said opening.

6. The method of claim 1, comprising:

using an exterior structure to define a flowpath leading to at least one of said openings.

7. A method of controlling flow into production tubing from a formation comprising:

locating a tubular having a plurality of openings adjacent the producing formation;

associating flow regulation devices with said openings;

expanding said tubing in a region adjacent said openings;

balancing inflow from the formation into the tubular through said openings after expansion;

directing flow from opposed directions outside of said tubular toward at least one of said openings.

8. A method of controlling flow into production tubing from a formation comprising:

locating a tubular having a plurality of openings adjacent the producing formation;

associating flow regulation devices with said openings;

expanding said tubing in a region adjacent said openings;

balancing inflow from the formation into the tubular through said openings after expansion;

providing an exterior structure over at least one of said openings;

forming said structure from a continuous L-shaped ring which spans said at least one opening.

9. The method of claim 8, comprising:

placing at least one of said flow regulation devices between at least one said ring and said tubular.

10. The method of claim 3, comprising:

placing a porous media in said path to act as said flow regulation devices.

11. The method of claim 10, comprising:

using said flow regulation devices to filter fluid passing therethrough.

12. The method of claim 5, comprising:

directing flow through discrete screens of said screen assembly before said flow is directed to at least one of said flow regulation devices.

13. The method of claim 12, comprising:

using a metal or non-metallic porous weave as at least one said flow regulation device.

14. The method of claim 13, comprising:

providing an outer protective jacket over said screens.

15. The method of claim 9, comprising:

supporting said ring from said tubular with porous media functioning as said at least one flow regulation device.

16. The method of claim 9, comprising:

providing a screen assembly to define at least one annular flowpath between itself and the outside of the tubular;

placing said at least one flow regulation device in said flowpath between said screen assembly and at least one of said openings.

17. The method of claim 10, comprising:

providing a screen assembly to define at least one annular flowpath between itself and the outside of the tubular;

placing said flow regulation devices in said flowpath between said screen assembly and at least one said opening.

18. The method of claim 16, comprising:

providing a plurality of screens in said screen assembly each with a said regulation device to provide differing resistance to flow for balancing flow to said screens.

19. A method of controlling flow into production tubing from a formation comprising:

locating a tubular having a plurality of openings adjacent the producing formation;

associating flow regulation devices which are uniquely configured from each other with said openings;

expanding said tubing in a region adjacent said openings;

balancing inflow from the formation into the tubular through said openings after expansion;

directing flow along the exterior of said tubular toward at least one of said openings through a path providing resistance to flow;

placing a porous media in said path to act as said flow regulation devices;

providing a screen assembly to define at least one annular flowpath between itself and the outside of the tubular;

placing said flow regulation devices in said flowpath between said screen assembly and at least one said opening;

providing a plurality of screens in said screen assembly each with a said regulation device to provide differing resistance to flow for balancing flow to said screens.

* * * * *